US007705276B2

(12) United States Patent
Giddings et al.

(10) Patent No.: US 7,705,276 B2
(45) Date of Patent: Apr. 27, 2010

(54) HEATER, APPARATUS, AND ASSOCIATED METHOD

(75) Inventors: Robert Arthur Giddings, Slingerlands, NY (US); Mark Philip D'Evelyn, Niskayuna, NY (US); Subhrajit Dey, Bangalore (IN); Bruce John Badding, Ballston Lake, NY (US); Larry Qiang Zeng, Strongsville, OH (US)

(73) Assignee: Momentive Performance Materials Inc., Uniondale, NY (US)

( * ) Notice: Subject to any disclaimer, the term of this patent is extended or adjusted under 35 U.S.C. 154(b) by 342 days.

(21) Appl. No.: 11/521,034

(22) Filed: Sep. 14, 2006

(65) Prior Publication Data

US 2008/0083741 A1 Apr. 10, 2008

(51) Int. Cl.
*H05B 1/02* (2006.01)

(52) U.S. Cl. ..... 219/497; 219/407; 219/494; 219/548; 373/136

(58) Field of Classification Search ..... 219/390, 219/393, 407, 543, 546, 548; 117/81, 82, 117/223; 373/136, 137
See application file for complete search history.

(56) References Cited

U.S. PATENT DOCUMENTS 3,427,011 A 2/1969 Boyer et al.
4,701,599 A * 10/1987 Miller ..... 219/544
4,753,192 A * 6/1988 Goldsmith et al. ..... 118/725
4,952,780 A * 8/1990 Curreri et al. ..... 219/390
5,315,085 A 5/1994 Ferguson
5,323,484 A * 6/1994 Nakao et al. ..... 392/416
5,769,944 A * 6/1998 Park et al. ..... 117/223
5,773,140 A 6/1998 Cerutti et al.
6,139,627 A * 10/2000 Duval et al. ..... 117/81
7,279,040 B1 * 10/2007 Wang ..... 117/81
2003/0145782 A1 8/2003 Kawase et al.
2006/0037529 A1 2/2006 D'Evelyn et al.

* cited by examiner

*Primary Examiner*—Mark H Paschall
(74) *Attorney, Agent, or Firm*—McDonald Hopkins LLC

(57) ABSTRACT

A heater that may include an outer housing and an inner tube is provided. The inner tube is in a coaxial relation to and within the outer housing. An inward facing surface of the inner tube defines a volume sufficient to receive a reaction capsule, and the outward facing surface is radially spaced from an inward facing surface of the outer housing sufficient to define a gap. A filler material is disposed within the gap. The filler material responds to pressure such that the filler volume is reduced by less than 5 volume percent at greater than 500 MPa pressure and at greater than 500° C. temperature. One or more heating elements are disposed in the gap. The heating elements are in thermal communication with the inner tube.

33 Claims, 4 Drawing Sheets

HEATER, APPARATUS, AND ASSOCIATED METHOD

BACKGROUND

1. Technical Field

The invention includes embodiments that relate to a heater, an apparatus that includes the heater, and associated methods.

2. Discussion of Related Art

A high pressure apparatus may include a heater that heats a work piece under pressure. The heater may include one or more heating elements. Heating elements suitable for use with a gas pressure medium may not be suited for use with a solid pressure medium that is pressed radially outward rather than uniformly pressurized from all directions (e.g., submerged in a high pressure environment). That is, the heater may change volume under operating conditions, but is not required to transfer pressure to or from the work piece. Known heaters for use in high pressure cells with a solid pressure medium may be single-use after being deformed with volume/shape changes in a high pressure high temperature environment, and some prior art single-use units have batch variability causing process variability from run to run.

It is desirable to have a heater, a heating element for use in the heater, and an apparatus that includes a heater that can be used in a high pressure high temperature apparatus with little change in volume, allowing for repeat usage. It is also desirable to have a method of making and/or using a heater, a heating element for use in the heater, and/or a high-pressure high temperature apparatus including a heater that can be used more than once.

BRIEF DESCRIPTION

The invention includes embodiments that relate to a heater. The heater includes a first tube, defining an axis, and the first tube has a first end and a second end, and the second end is spaced axially from the first end; an outer housing comprising at least one second tube; and a filler material disposed within the outer housing, wherein in response to a pressure that is greater than 500 MPa the filler material may decease in volume by less than 5 volume percent at a temperature that is greater than 500° C. One or more heating elements are disposed at least partially within the filler material. The heating elements thermally communicate with the first tube, which is disposed at least partially within or proximate to the outer housing. An inner surface of the first tube is capable of receiving a capsule and, after operating, releasing the capsule.

The invention includes embodiments that relate to a heater that includes a housing having an inner surface and an outer surface. The inner surface defines a chamber configured to receive a capsule, and the outer surface defines a groove or a channel. A heating element is disposed within the groove or the channel.

The invention includes embodiments that relate to a method of forming the heater. The method includes packing a bed with solid particulate to a density of greater than 50 volume percent; and infusing the packed bed with a cement material.

The invention includes embodiments that relate to an apparatus. The apparatus includes a heating element. The heating element heats to a temperature in a range of greater than 500° C.; a cement matrix encasing the heating element; a first tube communicating with an inward facing surface of the cement matrix and providing mechanical support thereto, and a second tube communicating with an outward facing surface of the cement matrix. During operation, energy supplied to the heating element causes thermal energy to flow into the first tube to a capsule disposed within a region of the first tube. The amount of thermal energy can be sufficient to increase the capsule temperature to be in a range of greater than 500° C., and can be sufficient to generate pressure within the capsule to be in a range of greater than 500 MPa as a response to the increase in temperature. This temperature and pressure increase occurs while the heater, in conjunction with a mechanical support of the second tube by the balance of the apparatus, restrains the first tube such that a volume within the capsule increases in an amount of less than 5 percent.

BRIEF DESCRIPTION OF THE DRAWING FIGURES

DETAILED DESCRIPTION

Figure 1:
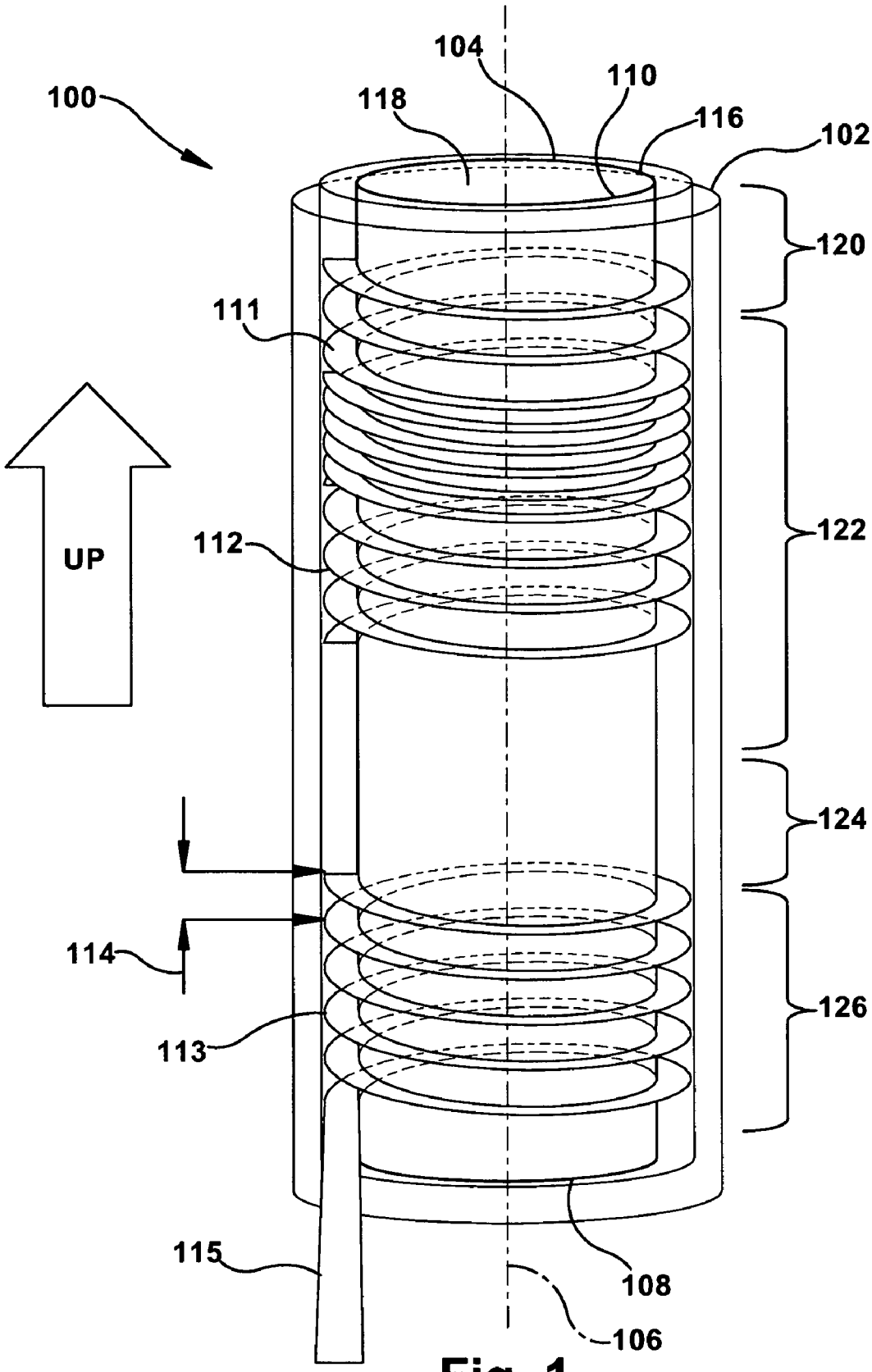
FIG. 1 is a schematic view showing a heater comprising an embodiment of the invention.

All ranges in the specifications and claims are inclusive of the endpoints and independently combinable. Numerical values in the specifications and claims are not limited to the specified values and may include values that differ from the specified value. The numerical values are understood to be sufficiently imprecise to include values approximating the stated values, allowing for experimental errors due to the measurement techniques known in the art and/or the precision of an instrument used to determine the values.

The range end limitations specified in the specification and claims, e.g., for temperature, pressure, concentration, etc., may be combined and/or interchanged and include subranges that are logical sub-units.

Approximating language, as used herein throughout the specification and claims, may be applied to modify any quantitative representation that could permissibly vary without resulting in a change in the basic function to which it is related. "Free" may be used in combination with a term, and may include an insubstantial number, or trace amounts, while still being considered free of the modified term. The term "pitch" includes the distance from any point on a winding to the corresponding point on an adjacent winding measured parallel to the longitudinal axis. Castable refers to a capability to be formed into a particular shape by pouring into a mold. As used herein, the term "groove" includes an elongate depression and/or cut-out in a surface for receiving a heating element, wherein the depression and/or cut-out has a cross-sectional shape lacking sub-surface corners. As used herein, the term "channel" includes an elongate depression and/or cut-out in a surface for receiving a heating element, wherein the depression and/or channel has a cross-sectional shape that includes at least one sub-surface corner.

An apparatus according to an embodiment of the invention includes a housing, a heater disposed within the housing, and a heating element disposed within the heater. In one embodiment, the housing includes a plurality of tubes. In another embodiment, a first tube and a second tube are elongate, each defining an axis. When placed in a coaxial relation relative to each other with the first tube disposed at least partially within the second tube, the first and second tube share a common axis. Each tube has an outward facing first surface and an inward facing second surface. The first surface of the first tube is spaced radially from the second surface of the second tube to define an annular space between the tubes. In one embodiment, one or both of the tubes can be cylindrical and/or formed from metal. In other embodiments, one or more tubes can be polygonal, such as hexagonal or pentagonal, and the sides can be irregular relative to each other.

The tubes each have a first end and a second end. The second end is spaced axially from the first end. In one embodiment, an end ring is welded to one tube or to both tubes, e.g., one end or both ends of each tube. The ring defines an end of the annular space between the first tube and the second tube. In one embodiment, each ring has a shape that corresponds to a shape of one or both tubes to which it is secured. For example, a cylindrical tube has a circular or disk-shaped end ring. The ring can be machined with a tolerance that minimizes the space between a contact area on the ring and a corresponding contact area on a surface of one or both of the tubes. Further, one or more apertures can be formed in the rings to allow for passage of one or more wires, or the like, from the annular space or gap through the ring and out to the ambient environment. The end ring can be secured to the tube end, or tube ends, by welding, brazing, or the like. In one embodiment, the end ring and the tube end are cooperatively threaded.

The second surface of the first tube can be sized, shaped and configured to receive a reaction capsule. Selection of materials and configuration allows for ease of release of the capsule after processing. In one embodiment, a reusable heater is provided that is capable of serially receiving a plurality of reaction capsules, and performing reactions in each of the capsules. In some embodiments, the first tube has a root-mean-square surface roughness less than 1 millimeter (mm). In a second embodiment, the tube does not have any gaps, cracks, or discontinuities with a dimension that is larger than 5 mm.

Examples of metals for use in the tube, and/or the ring include iron-based alloys, such as steel. In other embodiments, the tubes and ring ends can be formed from cermet, ceramic, or composite materials. In one embodiment, the first and second tubes, and corresponding end rings, include one or more high temperature superalloys exhibiting relatively low creep under operating conditions. Suitable superalloys include INCONEL 718 and HASTELLOY X, commercially available from Magellan Industrial Trading Company, Inc. (South Norwalk, Conn.).

The heating elements are disposed in the annular space between the first and second tubes. In one embodiment, the annular space is filled with a filler material such as cement, and includes one or more heating element disposed within the cement material. In one embodiment, the filler cement material is castable or settable, such that it can be poured or flowed as a liquid and then hardened into a solid. In one embodiment, the cement material has a relatively high-density and/or a low porosity. In another embodiment, the cement material has a relatively high-alumina content. The use of suitable cement material as a filler in the annular space between the first and second tubes helps transfer internal pressures from the first tube to the second tube during operation.

Suitable cement material can be selected based on compressive fracture, further densification, and/or creep of a finished part made from the cement being negligible under operating conditions. In one embodiment, the cement material comprises castable, high-alumina cement. In a second embodiment, the cement material has a relative density greater than 75% in comparison to its theoretical maximum density. In a third embodiment, the cement is selected for a relative density in a range selected from: 75-80%, 80-85%, 85-90%, 90-95%, and greater than 95% in comparison to the theoretical maximum density of the cement material.

Non-limiting examples of cements include alumina and magnesium oxide compounds. In one embodiment, the cement includes alumina that is present in an amount in a range of from 70-80 wt. %. In one embodiment, the cement includes alumina that is present in an amount greater than 50 wt. %. In one embodiment, the cement consists essentially of alumina and a binding compound. In one embodiment, the cement includes aluminum, magnesium, and at least one Group V metal on the periodic table. In one embodiment, the cement consists essentially of alumina and magnesium oxide. In one embodiment, the solid particulate for use in the cement has a surface coating that relatively increases the wetting and decreases void formation. Suitable cements are commercially available as AREMCO 575N and AREMCO 576N by Aremco Products, Inc. (Valley Cottage, N.Y.).

In one embodiment, the filler material is capable of resisting crushing, densification, or both under compression pressures of up to 1000 MegaPascal (Mpa) at process temperature of the apparatus. In one embodiment, the filler material in response to a pressure greater than 500 Mpa and a temperature greater than 500 degrees Celsius (° C.), the filler material decreases in volume by less than 5 vol. %. In one embodiment, the heater is used in an apparatus operating at a pressure range selected from any of from 10-50 MPa, 50-100 MPa, 100 MPa to 150 MPa, 150 MPa to 250 MPa, 250 MPa to 300 MPa, 300 MPa to 400 MPa, 400 MPa to 500 MPa, 500 MPa to 600 MPa, 600 MPa to 700 MPa, 700 MPa to 800 MPa, 800 MPa to 900 MPa, 900 MPa to 1000 MPa, and greater than 1000 MPa. In another embodiment, the heater is used at an operating temperature range selected from any of: 200-500° C., 500-750° C., 750-1000° C., 1000-1250° C., 1250-1500° C., and greater than 1500° C.

In one embodiment, the heater is formed by packing the annular space with a bed comprising particulate material that includes high-alumina grinding beads, or of large-sized (e.g., 1.5 mm average diameter) alumina fused-cast grains. The heating elements are arranged in a determined manner according to the desired end configuration of the heating elements in the bed. The bed can be packed using a vibratory device and/or a press. In one embodiment, the bed is packed with the solid particulate to a relative density of greater than 50 volume percent (vol. %). A suitable hydrating alumina-based cement can be used to impregnate, infuse, and/or percolate into the interstices or void space defined by the beads or the grains. After the cement material sets, the resultant cement structure has a suitable density as disclosed herein. This structure fills the space between the second and first metal tubes, and surround and support the heating elements.

In one embodiment, the cement portion of the heater can be formed as follows. The heater is partially assembled so that the first and second tubes are in place, as well as the heating elements and one end ring. The heater is stood on end with the open end up, and solid particulates are added to a shallow depth. The specific depth is determined by the ability to effectively infuse the bed with cement while avoiding air pocket formation. In some embodiments, appropriate depths are in a range of from 1-4 centimeters (cm). The particulates are then packed, for instance, by using a vibratory packing device. Then the effectiveness of the pack is checked visually using a boroscope. The packed bed is then infused with cement. In one embodiment, the cement is injected under pressure into the bed. Gas voids are removed from the bed by shaking, tapping and/or vibrating the bed until bubbles cease to form at the surface of the bed, as observed using a boroscope. Then additional particulate matter is added on top of the infused bed, and the foregoing process is repeated until the desired length of cement is formed. The cement is allowed to harden, and is then cured at an elevated temperature.

Appropriate curing temperatures can be determined by two factors: (1) the ability to drive off moisture from the cement, and (2) the prevention of excessive internal pressure in the heater, which may result in rupture. Suitable cure times can be in a range of 1 hr.-2 weeks, depending on the size of the heater. Completion of the curing process can be judged in one of several ways. In one embodiment, the curing process is considered complete when the electrical resistance across the cement is greater than 100 kiloOhm (kΩ). In another embodiment, greater than 1 megOhm (MΩ). In another embodiment, curing is considered complete when the electrical resistance across the cement is high enough for a DC high potential test at least 1 KiloVolt (KV) and at not more than 0.1 milliAmps (mA). In one embodiment, curing is considered complete when the electrical resistance across the cement is high enough for a DC high potential test at least 0.5 KV and at not more than 0.1 mA. In a DC high potential test, the DC voltage between two electrodes is incrementally increased while monitoring the current that flows between them. In this case, the heating element and the first and/or second tube can be chosen as the test electrodes. The test is considered successful if the voltage surpasses some threshold, for example 1 KV, without the current exceeding a set value, for example, 0.1 mA, indicating a high resistance that remains stable at high voltage. In another embodiment, curing is considered complete when no evolved humidity can be detected using a dew-point meter. In yet another embodiment, curing is deemed complete based on mass loss. For example, the mass of water remaining in the hardened cement can be calculated by first subtracting the mass of the baked heater from its mass before bake-out, then subtracting that difference from the mass of water added with the cement. Thus, the wet mass of the heater can be measured, and the curing process can continue until the mass of the device decreases by an amount equal to that of the calculated mass of excess water.

In some embodiments, the heater includes a plurality of heating elements that cooperate with each other to define a plurality of temperature-controllable heating zones, or hot zones. Each heating element includes one or more electrical leads. In one embodiment, the heating elements defining each heating zone is wound such that both ends, or both leads, of the same heating element exits from a single end of the structure. In one embodiment of a heater with two temperature-controllable heating zones, a pair of heating element ends or leads can exit from opposing ends of the heater. In another embodiment with two temperature-controllable heating zones, a pair of heating element ends or leads can exit from the same end. In embodiments having more than two hot zones, the heating element ends or leads can exit the housing, from one end, from either end, or from various points along the outward facing surface of the second tube.

The power density of the heater can be determined by controlling such factors as the winding density or the winding pitch, the selection of materials for use in the heating elements, the local cross sectional area of the heating element, and the like. In one embodiment, the winding density of the heating elements is relatively uniform, with variations of less than about 25%. In another embodiment, the winding density has variations of less than about 10%. In one embodiment, some portions of the heater have a higher winding density relative to other portions. In one embodiment, the end portions of the heater can have a relatively higher winding density relative to the middle portions of the heater. Controlling the power density allows for compensation of a higher heat loss rate at the ends relative to the region between the ends. In one embodiment, the temperature distribution is uniform over the length of the heater. In one embodiment, the winding density defines a gradient running from one end of the heater to the other define a temperature distribution pattern. In one embodiment, the temperature is relatively uniform within two or more axially-spaced hot zones, with a smooth transition in the temperature between adjacent zones. In some embodiments, the pitch can be selected to prevent, minimize, or eliminate wall nucleation during a high pressure crystal growth process.

Examples of suitable resistive heating elements include one or more of a wire, a ribbon, a coil, a foil, or a rod. One or more resistive heating elements can be wound around the axis in the annular space. The heating element thermally communicates with and is electrically insulated from the first tube. The winding can be a spiral, a helix, or a double helix. Some embodiments include triple or higher helices. A helix winding allows for two ends of the heating element to exit from the same end of the housing. A double helix allows for the ends of two independent heating elements to exit from the same end of the housing. Multiple windings of a plurality of heating elements allows for zone control of the heating elements as disclosed further herein. In one embodiment, the cross-sectional area of the heating element is constant along its length. In another embodiment, the cross-sectional area of the heating element varies along its length. An increase in the cross sectional area in one segment of the heating element will decrease the heating power density in this segment. Variation of the local heating power density of the element can be useful with double- or multiple-helix wound heating elements. For example, application of electrical current to a first heating element applies heating power primarily to a first heating zone, while application of electrical current to a second heating element applies heating power primarily to a second heating zone, even though both heating elements are both present in at least one zone in the form of a wound double-helix or a multiple-helix. Heater segments with different cross-sectional areas can be joined by welding, brazing, crimping, clamping, or the like. In another embodiment, the cross sectional area of a section of the heater segment is increased by twisting or otherwise electrical contacting one or more additional segments of wire with a first segment of wire.

In one embodiment, the heating element includes a resistive heating wire made from KANTHAL A-1. The heating element winds on the first metallic tube, thereby placing it in thermal communication with the first tube. In one embodiment, an electrically insulative coating and/or at least one ceramic rod, ceramic particulate filler, or cement can be used on the heating elements to electrically isolate the heating elements from the first tube. The electrically insulative coating and/or at least one ceramic rod, ceramic cylinder, ceramic particulate filler, or cement can also be used to electrically isolate the heating elements from each other, and, optionally, from the first tube. In one embodiment, the heating element comprises a wire fabricated from Nichrome®.

Examples of suitable electrically insulative coatings include ceramic materials, e.g., magnesium oxide. In one embodiment, the electrically insulative coating is a multi-layered structure. In another embodiment, the multi-layered structure has a composition that differs in a linear or non-linear fashion across its thickness to define a concentration gradient, e.g., one or more layers of yttria-stabilized zirconia (YSZ) and of alumina, which can be separated by a layer of a mixture of YSZ and alumina. Furthermore, the multi-layered structure may include one or more layers of YSZ, alumina, and/or a mixture thereof. The layered structure may include a ceramic insulating material deposited by, for example, plasma spraying or by electron-beam physical vapor deposition. A suitable composition for a ceramic rod is alumina. The same ceramic particulate filler and/or cement can be used to provide electrical isolation and thermal communication as is used to fill the annular space between the first and second tubes.

In one embodiment, one or more of the heating elements, heating element ends, or electrical leads, emerge from the heater through notches or apertures cut into the second metal tube or into the end ring. The heating elements, ends or leads, where they emerge, can be insulated from conductive ground faults, such as the first tube, and from each other, by an electrically insulative article. In one embodiment, the electrically insulative article comprises woven alumina or fiberglass sleeving. In another embodiment, the electrically insulative article comprises one or more sections of ceramic or glass tubing. In yet another embodiment, the electrically insulative article comprises ceramic or glass beads. An end ring can be secured or attached to an end of the heater, after the heater is formed in the annular space.

A particular example of a heater 100 including one or more embodiments in accordance with the invention is illustrated with reference to FIGS. 1-2. As shown, a second tube 102 has an inner surface that defines a volume in which a first tube 104 is coaxially nested on a defined axis 106. The second tube inner surface is spaced from the first tube 104 outer surface to define the elongate toroid, annular space, or gap therebetween. The up direction is indicated with an arrow labeled "up". The tubes 102, 104 have a first end 108, and a second end 110 axially spaced from the first end and relatively up therefrom. Accordingly, the term "top" refers to the second end unless context and language indicates otherwise.

A first resistive heating element 111, a second resistive heating element 112, and a third resistive heating element 113 are disposed within the annular space. In the illustrate embodiment, the heating elements are spirally wound. The windings are spaced from each other by a winding distance or pitch, for the third resistive heating element the pitch is indicated by the reference number 114. The first and second resistive heating elements extend axially different lengths from each other, which can allow for finer tuning of the temperature profile during use. Each of the first and second resistive heating elements are a double-helix allowing for both the leads of each heating element to exit from the same end of the heater. For the third resistive heating element, only one lead is shown and the lead that is not shown can, for example, exit from a side of the heater.

In the illustrated embodiment, the heating elements include 18-gauge metal wire that can operate with 208 volts, and 4000 Watts max. An electrical lead 115 for the third resistive heating element exits at the bottom of heater. Other electrical leads for the other heating elements are not shown. A relatively thicker cross section of the leads, relative to the heating elements, reduces electrical resistance and the heat associated with electrical resistance. In one embodiment, the relatively increased thickness is achieved by contacting additional lengths of wire to the lead wire outer surface to form a wire bundle. The wire bundle may be twisted while avoiding kinks, narrow spots, and the like, which would create localized electrical resistance and the heat associated therewith during use. In another embodiment, the lead is folded back on itself in a zig-zag to increase the cross-sectional thickness.

The first tube is coated with an electrically non-conductive ceramic coating. The electrically insulating ceramic coating electrically isolates segments of the heating element from at least the first tube. In the illustrated embodiment, the coating is a multi-layered composite structure. The composite structure includes layers of yttria-stabilized zirconia (YSZ) and alumina separated by a plurality of layers of differing mixtures of YSZ and alumina.

The annular space or gap is filled with a high-density and high-alumina content filler material 116. The filler material, which in one embodiment is a cement, transfers internal pressures from the first tube outward to the second tube during operation, thus minimizing heater volume changes/deformation and allowing the heater to be re-used.

The heating elements are in thermal communication with the first tube, and remain electrically insulated from both the first tube and the second tube. Starting from the top and working down, the arrangement of sets of heating elements defines several heat zones. The heat zones include an uppermost first zone 120, a growth zone 122, a baffle gap zone 124, and a charge zone 126. When a capsule is inserted into the volume defined by a first tube inner surface 118, an internal baffle (not shown) aligns with the baffle gap zone. The baffle defines two chambers inside the capsule, one for charge and one for growth. The two chambers communicate through the perforated baffle. The first tube inner surface 118 may have one or more characteristics as discussed further herein, particularly with reference to the release characteristics of the removable capsule.

In one embodiment, the capsule suitable for insertion inside the first tube 104 is formed from a precious metal. Examples of precious metals include platinum, gold, or silver. Other metals can include titanium, rhenium, copper, stainless steel, zirconium, tantalum, alloys thereof, and the like. In one embodiment, the metal functions as an oxygen getter. Suitable capsule dimensions may be greater than 2 cm in diameter and 4 cm in length. In one embodiment, the dimension of the diameter is in a range selected from any of: 2-4 cm, 4-8 cm, 8-12 cm, 12-16 cm, 16-20 cm, 20-24 cm, and greater than 24 cm. In a second embodiment, the ratio of the length to diameter of the capsule is greater than 2. In yet another embodiment, the ratio of length to diameter is in a range of any of: 2 to 4, 4 to 6, f to 8, 8 to 9, 9 to 10, 10 to 11, 11 to 12, 12 to 14, 14 to 16, 16 to 18, 18 to 20, and greater than 20.

In one embodiment, the growth zone 122 volume has twice the charge zone 126 volume. The electrical circuits for each heating element segments are independently controlled. Independent control provides flexibility to achieve and maintain a heat deposition profile along the capsule height. A physical discontinuity between the second and third heater segments, from the top, produces a local dip in temperature near a baffle plate disposed in the capsule and separating the charge zone 126 from the growth zone 122. In one embodiment, the charge zone and the growth zone are isotherms at temperatures that differ from each other. The baffle zone has a temperature gradient over a relatively small distance between the charge zone and the growth zone isotherms. The winding patterns of the heating elements, and the resultant isotherms with minimal temperature gradient spacing therebetween minimize or eliminate wall nucleation inside the capsule. In one embodiment, the growth zone may be at the bottom and the charge zone at the top. Such configurations may be based on specific chemistries and growth parameters.

In yet another embodiment (not illustrated), the heater has only one tube (a first tube 104). During heater fabrication, a second tube is disposed coaxially outside of the first tube to form an annular space to be filled with a filler material. After partial or complete curing of the filler material, the second tube is then removed by means known in the art and thus does not become a component of the fabricated heater. In one embodiment, the second tube is removed mechanically via grinding. In a second embodiment, the second tube is removed chemically via dissolution. Final curing of the filler material may be performed after removal of the second tube. In yet another embodiment of a heater having a single tube (not illustrated), the first tube is inserted into a mold, wherein the outer surface of the tube and an inner surface of the mold form an annular space of a cylindrical, polygonal, or irregular shape to be filled with a filler material. The mold may be porous, allowing moisture and other gaseous materials to escape from the annular space during curing of the filler material, thus shortening the curing time and improving uniformity of the cured filler material. The mold may comprise one or more parts and may be removed after partial or complete curing of the filler material by disassembly, fracture, grinding, or the like. Final curing of the filler material may be performed after removal of the mold.

Figure 2:
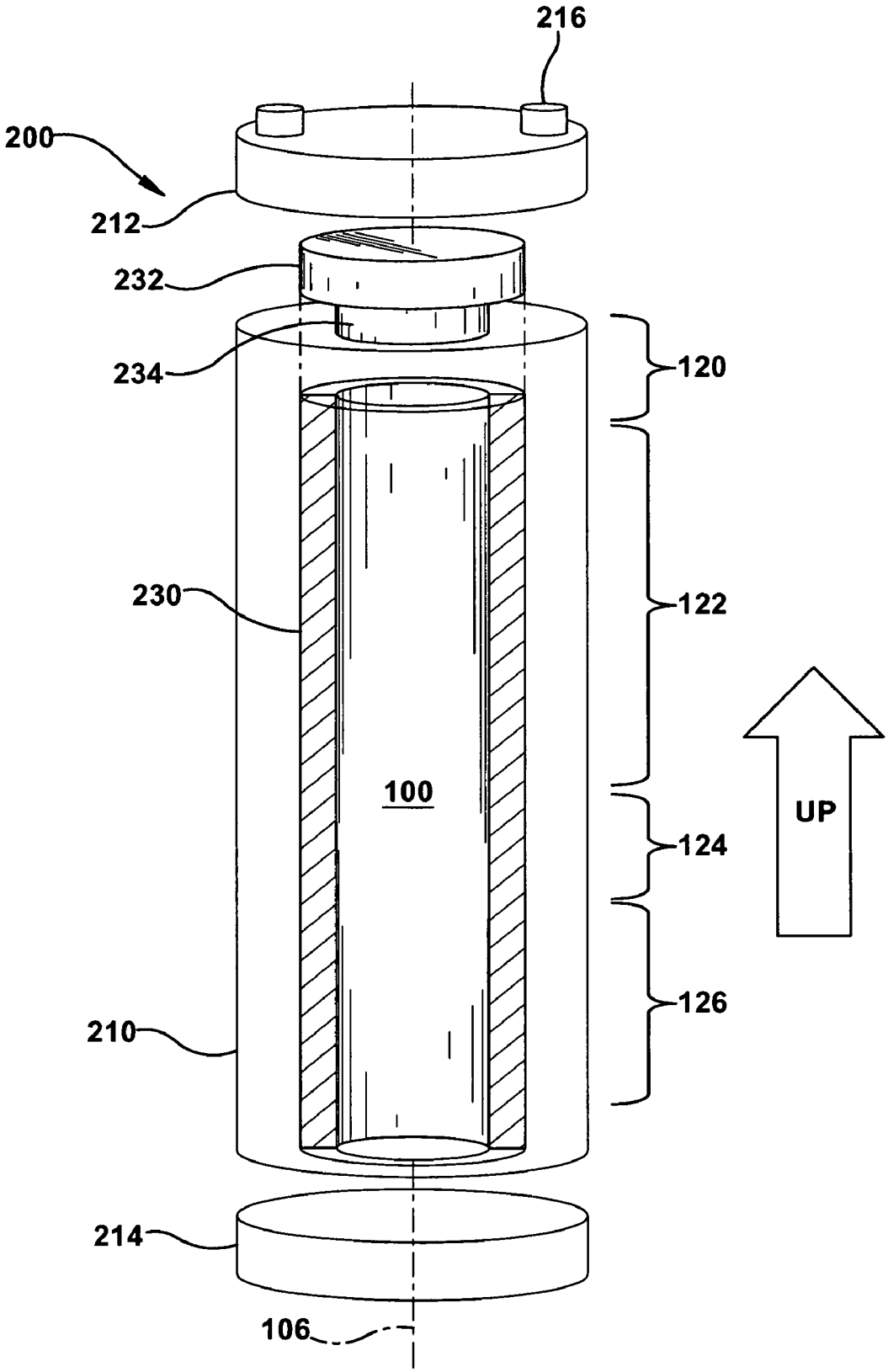
FIG. 2 is a schematic view showing an apparatus comprising an embodiment of the invention with which the heater of FIG. 1 may be used.

With particular reference to FIG. 2, the heater 100 is disposed in an apparatus 200 that includes a vessel 210. Attachable to the top end of the vessel is a first end cap 212, and to the bottom end is a second end cap 214. A plurality of fasteners 216 (only one of which is indicated with a reference number) secure the end caps to the vessel ends.

Within the vessel 210, pressure transfer medium 230 lines the vessel inner surface and contacts the outer surface of the heater 100. Examples of pressure transfer medium include but are not limited to zirconium oxide or zirconia. First and second pressure transfer medium caps 232 (only one of which is shown) are located proximate to the ends of the heater 100 inside the vessel. An annular plug 234 is shown as stacked disks, but may be an annulus surrounding the cap 232. The plug 234 optionally can be disposed on at least one end and within a cavity between the end of the heater and the end ring to reduce axial heat loss. The plug is commercially available from a variety of sources including Thermal Ceramics Worldwide (Augusta, Ga.), under the trade name KAOWOOL.

In the illustrated embodiment, Nichrome® heating elements 112 are embedded in a filler material 116. The layer of pressure transfer medium is placed around the heater 100 with the ends receiving the plug. Alternative plug materials may include magnesium oxide, salts, and phyllosilicate minerals such as aluminum silicate hydroxide or pyrophyllite.

The illustrated apparatus 200 can be used to grow crystals under pressure and temperature conditions desirable for crystal growth, e.g., gallium nitride crystals under related process conditions. The high-pressure apparatus 200 can include one or more structures operable to support the heater 100 radially, axially, or both radially and axially. The support structure in one embodiment thermally insulates the apparatus 200 from the ambient environment, and such insulation may enhance or improve process stability, maintain and control a desired temperature profile.

Figure 3:
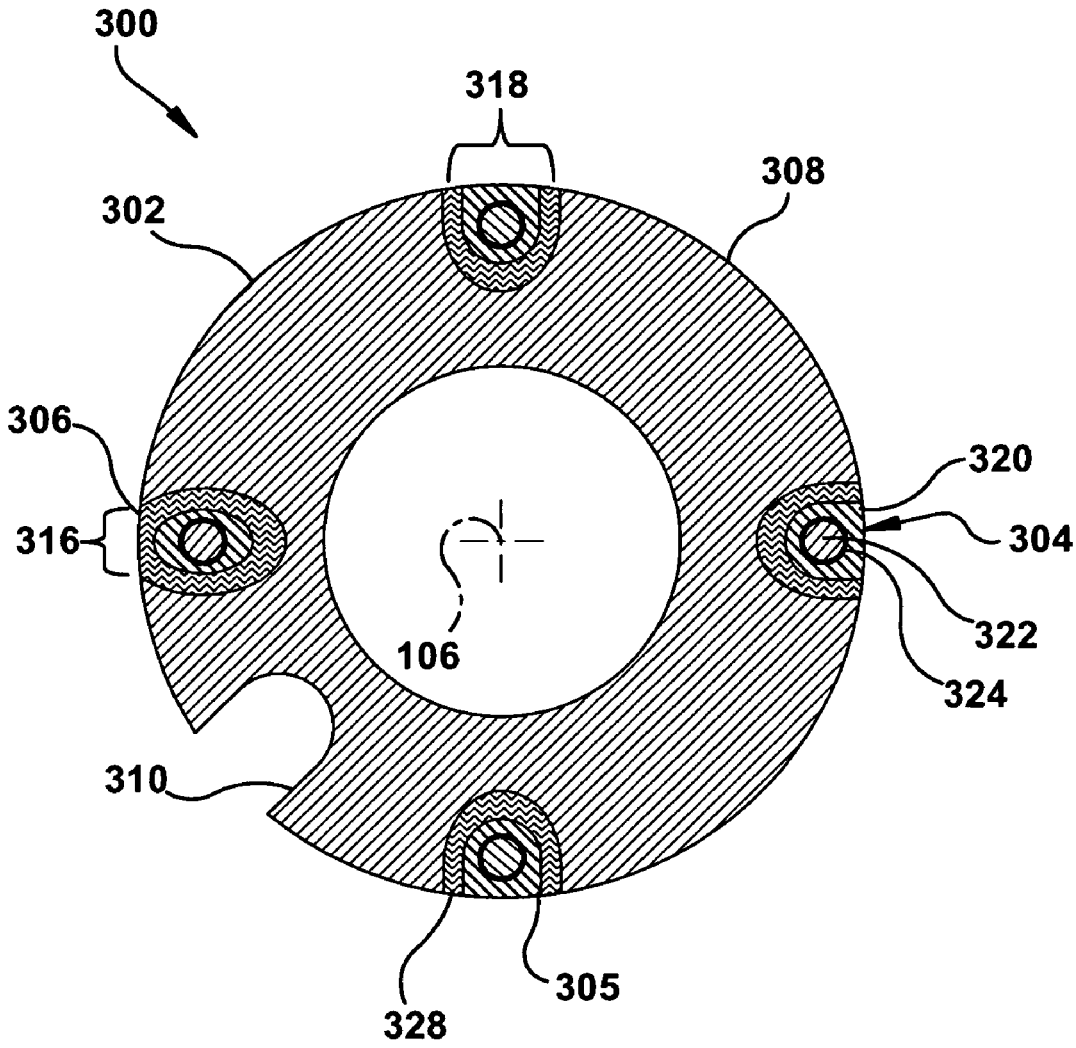
FIG. 3 is a schematic view showing a heater comprising an embodiment of the invention.

With reference to FIG. 3 for another heater embodiment 300, which is shown in cross-sectional top plan view. The heater 300 includes a first tube 302 and a heating assembly 304. The heating assembly can have differing cross-sectional shapes as indicated by the reference number 305, 306 which show a horseshoe and an oval cross-section, respectively. The first tube has a housing or outer surface 308 that defines at least one groove or channel 310. Each heating assembly (304, 305, and 306) includes a second outer tube 320, a central heating element 322, and an electrically insulative ceramic filler 324 disposed between the second tube and the heating element. The labeled groove does not have a heating assembly disposed therein for clarity of illustration. Grooves or channels of differing depths can be used in the same or in differing heaters according to embodiments of the invention. In addition, grooves with differing opening widths can be used. For example, the opening width of an opening 316 is relatively narrower than the opening width of another opening 318. As the defined volume of the groove or channel moves radially inward while retaining curved sidewalls, in one embodiment the opening width may decrease. If the opening width decreases to less than the width of the heating element, the heating element (or a second tube) can be inserted axially from, for example, an end. In alternative embodiments, the width can decrease to zero.

The heating assembly 304 nestingly fits into the groove 310. The heating assemblies 304 can be a CALROD heating assembly. The heating assembly 304 includes an optional second, outer tube 320, a central heating element 322, and an electrically insulative ceramic filler 324 disposed between the second tube and the heating element.

Residual space or porosity between the heating element and the second tube can be removed or minimized by swaging the second tube down onto the heater with surrounding ceramic filler to fabricate the assembly. The channel or groove 310 can compliment the shape of the heating assembly 304. The groove surface can be machined, ground, or polished before insertion of the heating element to provide a smooth finish, tight tolerance, and enhanced thermal communication. The groove can have a serpentine shape, with the heating assembly bent into a serpentine shape so as to fit into the groove, so that one or more heating assemblies can be used to provide even heating over the inner portion of the first tube.

In one embodiment as illustrated with heater assembly 305, the space in the groove 310 between the first tube surface 308 and the outer surface of heating assembly 305 is filled with a cement material 328, which can be either electrically conductive or electrically insulative. Some embodiments may include adding additional cement material at the corners. This additional cement serves to round out the corners, enhancing thermal and/or structural integrity.

In yet another embodiment of a heater assembly without the second tube the assembly comprises a heating element 322, which is disposed inside the space in the groove or channel 310. A filler material (cement) is disposed between the heating element 322 and the first tube surface 308. The filler material may be cured as described above. In an example wherein the filler material is electrically conductive, the heating element 322 is first coated with an electrically insulating material of sufficient dielectric strength.

In another embodiment, rather than the cement material, the remaining space in the groove can be filled with the same material as the first tube. The tube filler material can be deposited electrochemically, by powder metallurgy, by physical vapor deposition, by chemical vapor deposition, or the like.

Figure 4:
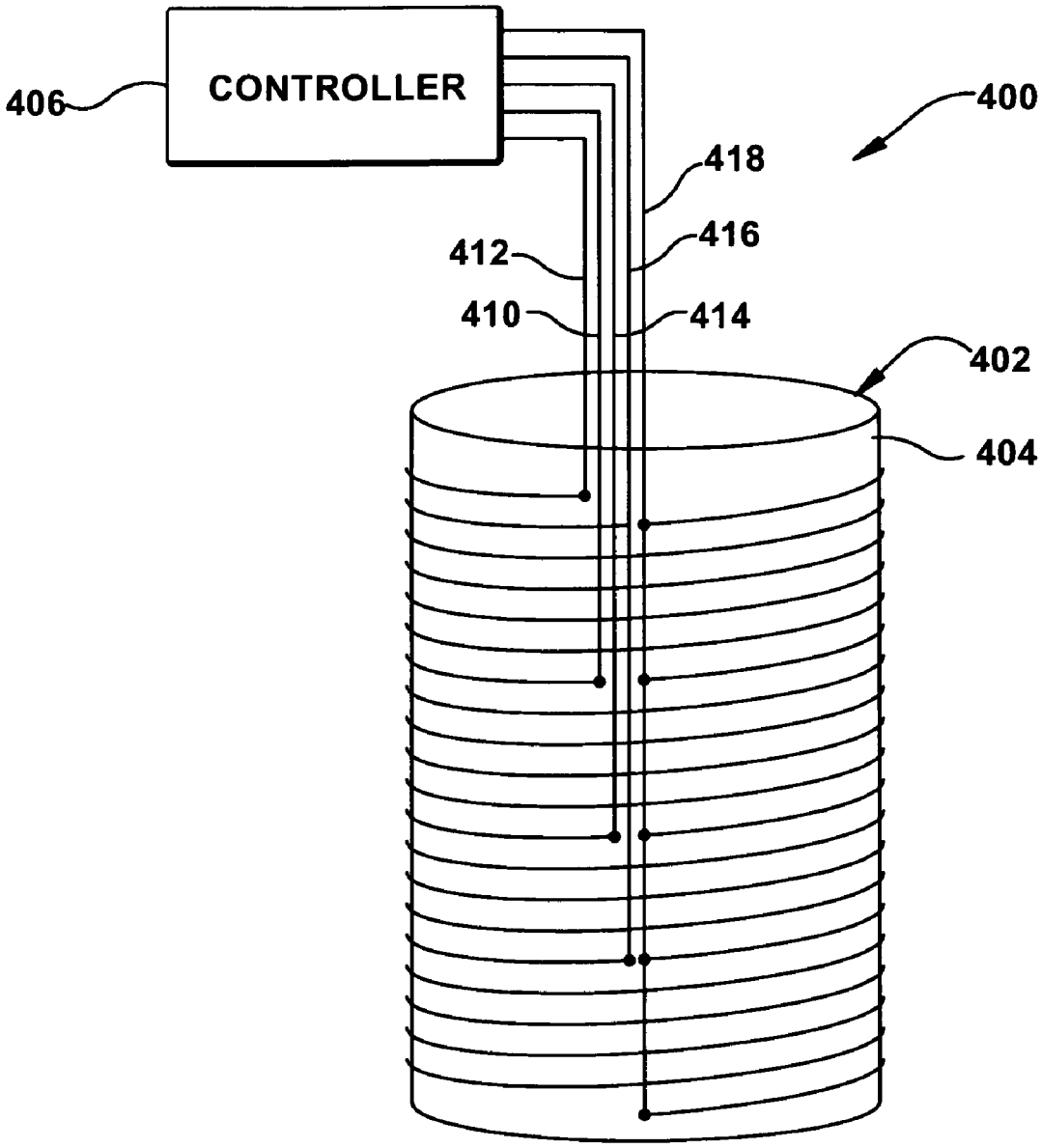
FIG. 4 is a schematic view of an apparatus according to an embodiment of the invention.

In one embodiment, the heater may include a plurality of differing heating elements, defining two, three or more hot zones in which the temperature is controllable. Multiple hot zones can be accommodated, as indicated by the assembly 400 in FIG. 4. The first tube 402 is coated with a first insulating ceramic layer 404. A controller 406 communicates from and to a plurality of heating element segments 410, 412, 414, 416 comprising fractional or multiple windings wrap around the thermally conductive and electrically insulated first tube during formation. A common segment 418 is also present to complete the circuit. Additional insulating ceramic layers (not shown) can be placed on top of one or more of the heating element segments, electrically isolating them from the leads to controller 406. One or more electrical contacts can be used to connect to ends of the heating element segments.

The electrical contacts can be fabricated from a relatively heavier gauge material and/or a lower resistivity material, so that most of the heat generation degrees occurs preferentially within the heating element segments rather than in the electrical leads. The electrical leads can be attached to the heater segments by spot welding, arc welding, ultrasonic welding, brazing, quick connect fasteners, screw clamps, or the like. The one or more additional ceramic coatings can reduce or eliminate shorting of the electrical lead wires to the other heater segments. A castable ceramic cement material (not shown) may encase, or be cast onto, the above-described assembly. The second tube may be placed over the assembly to complete one heater according to an embodiment of the invention.

The controller 406 communicates with sensors (not shown) and with the heating elements 410, 412, 414, 416. Suitable sensors include temperature sensors and/or pressure sensors located proximate to the zones being sensed. In one embodiment, the temperature sensor comprises a thermocouple. The presence of multiple zones allows for a desirable amount of control of temperature distribution within the heater 400 by the controller 406, and ultimately control over heat distribution within the first tube 104 and/or the reaction capsule (if present). In addition, the electrical power to each segment can be programmed as a function of time, so that the controller can manipulate the temperature distribution within the heater 400. Such control over temperature distribution is useful for a variety of crystal growth methods, such as a hydrothermal crystal growth method.

In one embodiment of a crystal growth process, energy supplied to the heating element causes thermal energy to flow into the first tube to a capsule disposed within a region of the first tube. The heat provided increases the capsule temperature to be in a range of greater than 500° C., and can be sufficient to generate pressure within the capsule to be in a range of greater than 500 MPa as a response to the increase in temperature. In operation, the filler material transfers internal pressures from the first tube outward to the second tube during operation, thus minimizing heater volume changes/deformation. As the filler material is substantially incompressible, it helps maintain the volume and/or shape of the heater. In one embodiment with the use of end ring secured to the first ends of the tubes, the volume and/or shape of the heater can be further secured in operation.

As the volume of the first tube is minimally changed and its shape is minimally deformed, the heater can be reused for subsequent high-pressure high temperature operations. In one embodiment, the change in the internal volume of the first tube (as defined by the interior of the first tube and the two ends) is less than 10 vol. %. In a second embodiment, the first tube incurs an internal volume change of less than 5%. In a third embodiment, a volume change of less than 2%. In one embodiment, the change in the external volume of the first tube (as defined by the interior volume of the housing) is less than 10 vol. %. In a second embodiment, the first tube incurs an external volume change of less than 5%. In a third embodiment, an external volume change of less than 2%. As the heater inner (first) tube incurs minimal volume change and experiences few or no gaps, cracks, or discontinuities, a capsule placed in the heater for processing at high pressure/high temperature can be slidingly removed from the heater after the operation is completed. As used herein, "slidingly removed" means that the capsule can slide off the inside surface of the first tube without the need to use excessive force and without permanent damage to the heater. In one embodiment, the capsule is hydraulically loaded on one end, e.g., with the use of a hydraulic piston, to slide out from the inside of the first tube. A mechanical restraint may be provided in order to prevent removal of the heater from a pressure transfer material. After the capsule is slidingly removed from the first tube after the initial operation, the heater can still be reused multiple times.

The embodiments described herein are examples of compositions, structures, systems and methods having elements corresponding to the elements of the invention recited in the claims. This written description enables one of ordinary skill in the art to make and use embodiments having alternative elements that likewise correspond to the elements of the invention recited in the claims. The scope thus includes compositions, structures, systems and methods that do not differ from the literal language of the claims, and further includes other compositions, structures, systems and methods with insubstantial differences from the literal language of the claims. While only certain features and embodiments have been illustrated and described herein, many modifications and changes may occur to one of ordinary skill in the relevant art. The appended claims are intended to cover all such modifications and changes.

What is claimed is:

1. A heater for use in a high pressure high temperature apparatus, the heater comprising:

a first tube defining an axis, the tube has a first end and a second end, and the second end is spaced axially from the first end, the tube having an outer surface and an inner surface, the inner surface capable of receiving a capsule;

a filler material disposed about or proximate to the outer surface of the tube;

one or more heating elements in thermal communication with the tube and disposed at least partially within the filler material;

wherein in response to an operating pressure that is greater than 150 MPa and a temperature that is greater than 200° C., the filler material volume decreases less than 5 volume percent.

2. The heater of claim 1, wherein in response to an operating pressure that is greater than 500 MPa and a temperature that is greater than 500° C., the filler material volume decreases less than 5 volume percent.

3. The heater of claim 1, wherein the first end and the second end of the first tube define an internal volume, and wherein in response to an operating pressure that is greater than 150 MPa and a temperature that is greater than 200° C., the filler material volume decreases less than 5 volume percent and the internal volume changes less than 10 vol. %.

4. The heater of claim 1, wherein the first end and the second end of the first tube define an internal volume, and wherein in response to an operating pressure that is greater than 500 MPa and a temperature that is greater than 500° C., the filler material volume decreases less than 5 volume percent and the internal volume changes less than 10 vol. %.

5. The heater of claim 3, further comprising a second tube or a housing and wherein the filler material is disposed between the first tube and the second tube or the housing.

6. The heater of claim 5, wherein the second tube has a first end and a second end, and the second end is spaced axially from the first end, and the first end and the second end of the second tube define an internal volume, and wherein in response to an operating pressure that is greater than 150 MPa and a temperature that is greater than 200° C., the filler material volume decreases less than 5 volume percent and the internal volume changes less than 10 vol. %.

7. The heater of claim 5, wherein the tube is in a coaxial relation to the second tube or the housing, and the first tube having an inward facing surface and an outward facing surface, the inward facing surface being radially spaced from the axis to define a volume sufficient to receive a reaction capsule, and the outward facing surface being radially spaced from an inward facing surface of the second tube sufficient to define a gap; and the filler material is disposed within the gap.

8. The heater of claim 5, wherein the filler material is operable to transfer an internal pressure of the first tube radially outward and to the second tube or the housing during operation.

9. The heater of claim 1, wherein the inner surface of the first tube has a root-mean-square surface roughness less than 1 millimeter, and does not have one or more gaps, cracks, or discontinuities with a dimension that is larger than 5 millimeters.

10. The heater of claim 1, wherein the filler material comprises a castable or moldable cement.

11. The heater of claim 1, wherein the filler material comprises magnesium oxide, alumina, or both magnesium oxide and alumina, in an amount in a range of from 70 weight percent to 80 weight percent.

12. The heater of claim 1, wherein the filler material has an electrical resistance greater than one hundred kiloOhm (kω).

13. The heater of claim 1, wherein the filler material has a volume reduction of less than 10 percent at a pressure of greater than 700 MPa, and at a temperature of greater than 700 degrees Celsius.

14. The heater of claim 1, wherein the filler material has a density of at least 75 percent of the theoretical maximum density.

15. The heater of claim 1, wherein the first tube outer surface defines a channel or groove, and at least one of the one or more heating elements are contained within assemblies that are disposed at least partially within the channel or groove.

16. The heater of claim 15, wherein the groove defines at least a portion of a circular cross section.

17. The heater of claim 1, wherein the heating element is one of a foil, a ribbon or wire, and defining a spiral, a serpentine, a single helix, a double helix, or a multiple helix pattern.

18. The heater of claim 5, wherein the heating element is electrically insulated from the first tube, from the second tube, or from both the first tube and the second tube by an electrical insulation layer.

19. The heater of claim 18, wherein the electrical insulation layer comprises an electrically insulative ceramic coating.

20. The heater of claim 18, wherein the electrical insulation layer is multi-layer, and the multi-layer coating has differing compositions from sub-layer to sub-layer to define a gradient of compositions across a thickness of the electrical insulation layer.

21. The heater of claim 18, wherein the electrical insulation layer comprises one or more of yttria-stabilized zirconia (YSZ), a mixture of alumina and YSZ, or alumina.

22. The heater of claim 5, further comprising one or more electrically insulating materials disposed in the filler material, the electrically insulating materials being capable of insulating at least one of the heating elements from first tube, from the second tube, from both the first tube and the second tube, or from other of the heating elements.

23. The heater of claim 5, further comprising a first end ring secured to the first end of first tube, to the first end of the second tube, or to the first end of both the first tube and of the second tube.

24. The heater of claim 22, wherein at least one end ring defines an aperture or a groove configured to allow a heating element to communicate therethrough, and further comprising one or more electrical leads in electrical communication with the heating element and with an external power source.

25. The heater of claim 1, wherein the heating element is one of a plurality of heating elements disposed in the filler material, each of the heating elements communicating with a controller that is operable to control power to the plurality of heating elements sufficient to achieve temperature in a zone in a reaction capsule.

26. The heater of claim 25, wherein the reaction capsule is capable of receiving and retaining a medium that responds to heat and pressure by becoming supercritical, and wherein an interior volume of the first tube, in which the reaction capsule is disposed during operation, is configured to define a constant volume to allow pressure in the reaction capsule to build in response to the temperature such that the temperature and pressure in the reaction capsule, during operation, are sufficiently high so that the medium is supercritical and the necessary pressure for supercriticality is supplied by the restraint on volume provided by the inner surface of the first tube passively restraining an outer surface of the reaction capsule.

27. A heater apparatus for use in a high-pressure high temperature apparatus, comprising:

a first tube having an inner surface and an outer surface, the inner surface defines a chamber configured to receive a capsule, and the outer surface defines at least a groove or a channel;

a filler material disposed within the groove or channel, at least a heating element disposed within the filler material, the heating element is in thermal communication with the first tube and electrically insulated from the first tube by the filler material;

wherein in response to an operating pressure that is greater than 150 MPa and a temperature that is greater than 200° C., the filler material volume decreases less than 5 volume percent.

28. The heater apparatus of claim 27, further comprising an electrically non-conductive ceramic coating contacting an outer surface of the heating element and the inner surface of the groove or channel.

29. The heater apparatus of claim 27, farther comprising at least a second tube disposed within the groove or channel, and wherein the filler material is disposed within the second tube, the heating element disposed within the second tube and electrically insulated from the second tube by the filler material.

30. The heater apparatus of claim 27, wherein the filler material comprises magnesium oxide, alumina, or both magnesium oxide and alumina, and wherein the filler material has an electrical resistance greater than 100 kiloOhm.

31. The heater apparatus of claim 27, further comprising an electrically conductive or an electrically insulative cement disposed within the groove or channel and outside the second tube, separating the second tube from the groove or channel.

32. An apparatus, comprising:

a heating element operable to heat to a temperature in a range of greater than 500° C.;

a cement matrix encasing the heating element, the cement matrix having a first surface and a second opposing surface;

a first tube communicating with the first surface of the cement matrix and providing mechanical support thereto, and a second tube communicating with the second surface of the cement matrix; and during operation, energy supplied to the heating element causes thermal energy to flow into the first tube to a capsule disposed within a region of the first tube, the thermal energy is sufficient to increase the capsule temperature to be in a range of greater than 500° C., and to generate pressure within the capsule to be in a range of greater than 500 MPa as a response to the increase in temperature while the first tube is restrained by the cement matrix such that a volume within the capsule increases in an amount of less than 5 percent.

33. The system of claim 32, wherein the capsule removes or separates from the region of the first tube and is not adhered, bonded, or welded therein.

* * * * *